US009395687B2

(12) United States Patent
Tomono et al.

(10) Patent No.: US 9,395,687 B2
(45) Date of Patent: Jul. 19, 2016

(54) ELECTROPHOTOGRAPHIC APPARATUS AND PROCESS CARTRIDGE

(71) Applicant: CANON KABUSHIKI KAISHA, Tokyo (JP)

(72) Inventors: Hiroyuki Tomono, Numazu (JP); Yota Ito, Mishima (JP); Daisuke Miura, Tokyo (JP); Takashi Anezaki, Hiratsuka (JP); Harunobu Ogaki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/832,834

(22) Filed: Aug. 21, 2015

(65) Prior Publication Data

US 2016/0054703 A1 Feb. 25, 2016

(30) Foreign Application Priority Data

Aug. 25, 2014 (JP) ..... 2014-170999

(51) Int. Cl.
*G03G 21/18* (2006.01)

(52) U.S. Cl.
CPC ..... *G03G 21/1814* (2013.01)

(58) Field of Classification Search
CPC combination set(s) only.
See application file for complete search history.

(56) References Cited

U.S. PATENT DOCUMENTS 5,995,785 A * 11/1999 Kato ..... G03G 21/0005 399/127
2008/0070135 A1* 3/2008 Tada ..... G03G 5/04 430/57.1

FOREIGN PATENT DOCUMENTS

JP H01-277269 A 11/1989
JP 2005-172863 A 6/2005
JP 2005-300741 A 10/2005

* cited by examiner

*Primary Examiner* — Clayton E Laballe
*Assistant Examiner* — Jas Sanghera
(74) *Attorney, Agent, or Firm* — Canon USA Inc. IP Division

(57) ABSTRACT

An electrophotographic apparatus includes an electrophotographic photosensitive member, a charging unit, and a transfer unit and satisfies the following formulae (1) to (3):

$$L1<L3 \quad (1)$$

$$L1>L2 \quad (2)$$

$$L1>L4 \quad (3)$$

where L1 represents a range from the center of an image-forming region of the electrophotographic photosensitive member to an end of a charged region in a longitudinal direction of the electrophotographic photosensitive member, L2 represents a range from the center of the image-forming region to an end of a transfer region in the longitudinal direction, L3 represents a range from the center of the image-forming region to an end of a region where the surface layer is placed in the longitudinal direction, and L4 represents a range from the center of the image-forming region to an end of a region where the charge-generating layer is placed in the longitudinal direction.

8 Claims, 4 Drawing Sheets

ELECTROPHOTOGRAPHIC APPARATUS AND PROCESS CARTRIDGE

BACKGROUND OF THE INVENTION

1. Field of the Invention

The present invention relates to an electrophotographic apparatus and a process cartridge.

2. Description of the Related Art

In recent years, the following apparatuses have been widely used: electrophotographic apparatuses using a contact charging method in which a voltage is applied to a charging member (contact charging member) contacting a cylindrical electrophotographic photosensitive member such that the electrophotographic photosensitive member is charged. Examples of the contact charging method include an AC/DC contact charging method in which a voltage obtained by superimposing an alternating-current voltage on a direct-current voltage is applied to the charging member and a DC contact charging method in which a direct-current voltage only is applied to the charging member.

In the contact charging method, the influence of discharge occurring near a contact surface of the charging member strongly acts on the electrophotographic photosensitive member and therefore a surface of the electrophotographic photosensitive member is likely to be worn. Japanese Patent Laid-Open No. 2005-300741 describes that the local surface abrasion of an electrophotographic photosensitive member is reduced by adjusting the distance between the position of an end portion of a charging unit and the position of an end portion of a development unit to 8 mm or less.

Japanese Patent Laid-Open No. 01-277269 discloses an electrophotographic apparatus having an effective transfer width less than an effective charge width and describes that the contamination of a transfer unit with tonner is reduced.

Japanese Patent Laid-Open No. 2005-172863 describes that a surface layer of an electrophotographic photosensitive member contains a compound cured by polymerization and a contact charging member and a cleaning member are brought into contact with each other in a region where the surface layer is present. This reduces the local surface abrasion of the electrophotographic photosensitive member that contacts an end portion of the contact charging member.

Recently, electrophotographic apparatuses have been required to increase the rotation speed of an electrophotographic photosensitive member in association with an increase in print speed and have been required to efficiently clean spherical or small-particle toner used to achieve high image quality. This increases the friction of a charging unit with the electrophotographic photosensitive member. Investigations performed by the inventors have revealed that the local surface abrasion of the electrophotographic photosensitive member needs to be improved in an end portion of a contact region between the electrophotographic photosensitive member and the charging unit. In particular, the discharge current flowing through the end portion of the contact region between the electrophotographic photosensitive member and the charging unit is larger than the discharge current flowing through a central portion of the contact region therebetween and therefore the current density of the end portion is specifically high. This probably causes the chemical deterioration of a surface of the electrophotographic photosensitive member, which is likely to be worn by the friction with the charging unit. The local surface abrasion of the electrophotographic photosensitive member is likely to induce the leakage of a charging bias to cause image defects.

SUMMARY OF THE INVENTION

The present invention provides an electrophotographic apparatus which is capable of reducing the local surface abrasion of an electrophotographic photosensitive member and which suppresses image defects due to the surface abrasion of the electrophotographic photosensitive member and also provides a process cartridge.

An electrophotographic apparatus according to an aspect of the present invention includes a cylindrical electrophotographic photosensitive member for carrying a toner image, a charging unit contacting the electrophotographic photosensitive member, and a transfer unit for transferring the toner image carried on the electrophotographic photosensitive member onto a transfer material. The electrophotographic photosensitive member includes a charge-generating layer and a surface layer on the charge-generating layer. The electrophotographic apparatus satisfies the following formulae (1) to (3):

$$L1<L3 \quad (1)$$

$$L1>L2 \quad (2)$$

$$L1>L4 \quad (3)$$

where L1 represents a range (mm) from the center of an image-forming region of the electrophotographic photosensitive member to an end of a charged region of the electrophotographic photosensitive member in a longitudinal direction of the electrophotographic photosensitive member, L2 represents a range (mm) from the center of the image-forming region to an end of a transfer region of the electrophotographic photosensitive member in the longitudinal direction of the electrophotographic photosensitive member, L3 represents a range (mm) from the center of the image-forming region to an end of a region where the surface layer is placed in the longitudinal direction of the electrophotographic photosensitive member, and L4 represents a range (mm) from the center of the image-forming region to an end of a region where the charge-generating layer is placed in the longitudinal direction of the electrophotographic photosensitive member.

A process cartridge according to another aspect of the present invention is detachable from an electrophotographic apparatus body. The process cartridge includes a cylindrical electrophotographic photosensitive member for carrying a toner image and a charging unit contacting the electrophotographic photosensitive member. The electrophotographic photosensitive member includes a charge-generating layer, a surface layer on the charge-generating layer, and a transfer region capable of facing a transfer unit for transferring the toner image carried on the electrophotographic photosensitive member onto a transfer material.

The process cartridge satisfies Formulae (1) to (3).

Further features of the present invention will become apparent from the following description of exemplary embodiments with reference to the attached drawings.

DESCRIPTION OF THE EMBODIMENTS

Figure 1:
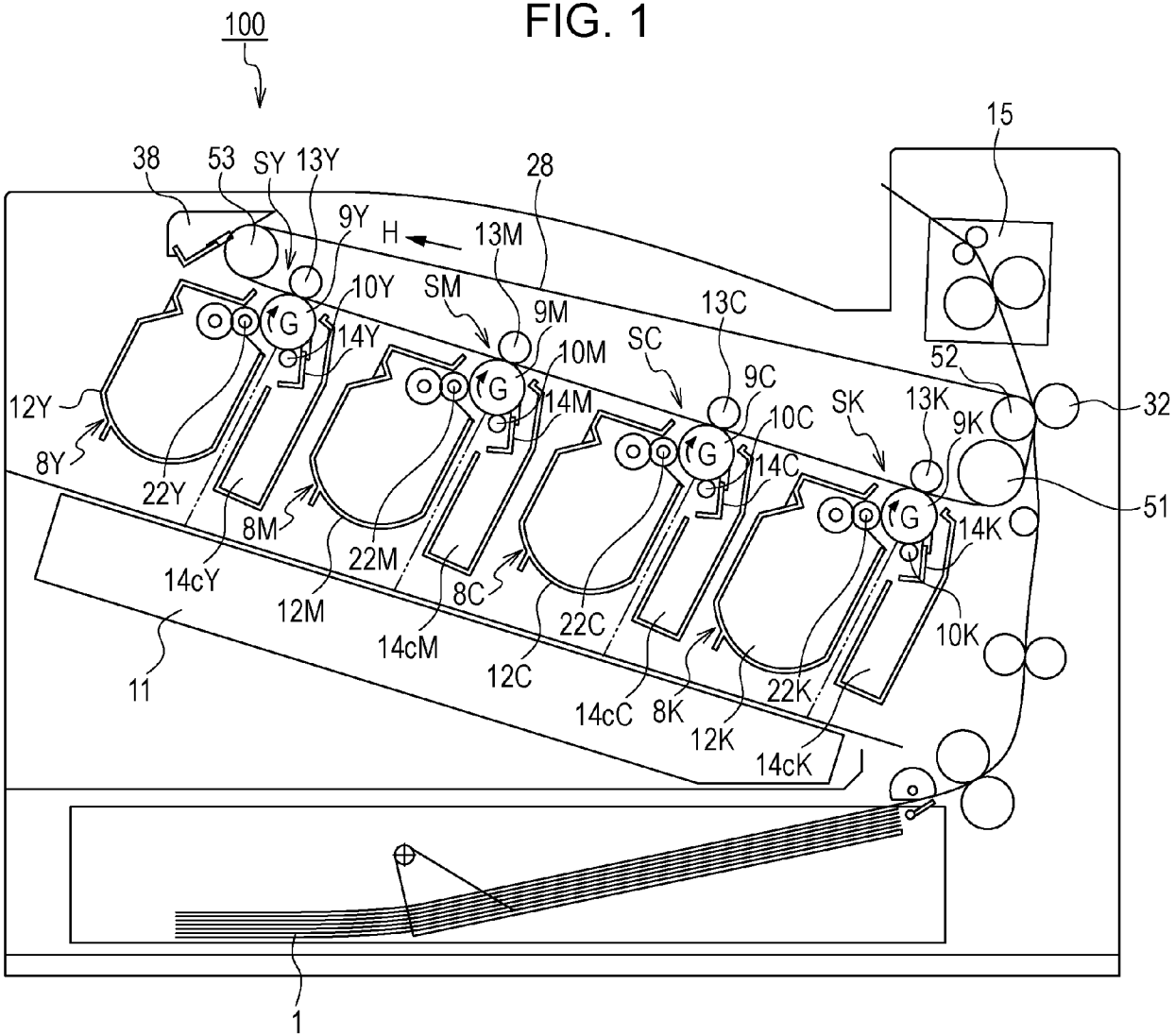
FIG. 1 is a schematic sectional view of an electrophotographic apparatus according to an embodiment of the present invention.

In the present invention, an electrophotographic apparatus includes a cylindrical electrophotographic photosensitive member, a charging unit, and a transfer unit. In the present invention, a process cartridge is detachable from an electrophotographic apparatus body and includes the cylindrical electrophotographic photosensitive member and the charging unit. The electrophotographic photosensitive member includes a charge-generating layer and a surface layer placed on the charge-generating layer. Furthermore, the electrophotographic photosensitive member includes a transfer region capable of facing the transfer unit.

The electrophotographic apparatus has a maximum sheet width equal to the lateral width of an LTR sheet. The longitudinal relationship between the electrophotographic apparatus and the electrophotographic photosensitive member is described below with reference to FIGS. 3 and 4.

The lateral width of the LTR sheet is about 216 mm. In the electrophotographic apparatus, an electrostatic latent image is formed over the lateral width of the LTR sheet. Therefore, the irradiation range of a laser beam emitted from a scanner unit for image formation is larger than the lateral width of the LTR sheet. That is, the relation that the lateral width of the LTR sheet is less than the irradiation range of the laser beam is set. The irradiation range (region) of exposure light (image exposure light) for image formation is an image-forming region. Incidentally, a region of the electrophotographic photosensitive member that is not irradiated with image exposure light emitted from an exposure unit is a non-image-forming region. When the image-forming region (image exposure range) is wider than the lateral width of the LTR sheet that is the maximum width of a sheet capable of being fed through the electrophotographic apparatus, an image can be formed over the LTR sheet. The center position of the image exposure range is the center of the image-forming region (the center of the image-forming region in a longitudinal direction of the electrophotographic photosensitive member). In order to control image formation conditions, exposure light is applied to the electrophotographic photosensitive member in some cases for the purpose of forming a developer image for image density control on the electrophotographic photosensitive member. However, the exposure light is not intended to form any image and therefore is not involved in defining the image-forming region.

In the present invention, the following formulae (1) to (3) are satisfied:

$$L1<L3 \quad (1)$$

$$L1>L2 \quad (2)$$

$$L1>L4 \quad (3)$$

where L1 represents a range (mm) from the center of the image-forming region of the electrophotographic photosensitive member to an end of a charged region of the electrophotographic photosensitive member in the longitudinal direction of the electrophotographic photosensitive member, L2 represents a range (mm) from the center of the image-forming region to an end of the transfer region of the electrophotographic photosensitive member in the longitudinal direction of the electrophotographic photosensitive member, L3 represents a range (mm) from the center of the image-forming region to an end of a region where the surface layer is placed in the longitudinal direction of the electrophotographic photosensitive member, and L4 represents a range (mm) from the center of the image-forming region to an end of a region where the charge-generating layer is placed in the longitudinal direction of the electrophotographic photosensitive member.

Two sets of L1 to L4 are present in the longitudinal direction of the electrophotographic photosensitive member. In particular, the one set is present on one end side of the electrophotographic apparatus and the other set is present on another end side thereof. In the present invention, L1 to L4 each represent a range from the center of the image-forming region in the longitudinal direction of the electrophotographic photosensitive member. When L1 to L4 present on either one end side or the other end side satisfy formulae (1) to (3), effects of the present invention are obtained. When L1 to L4 present on both one end side and the other end side satisfy formulae (1) to (3), effects of the present invention are excellent.

The inventors consider reasons why a surface (surface layer) of the electrophotographic photosensitive member is likely to be worn at an end portion of a contact region between the electrophotographic photosensitive member and the charging unit as described below.

In a contact charging method, a discharge phenomenon based on Paschen's law is used to charge the electrophotographic photosensitive member from the charging unit. When the electrophotographic photosensitive member is charged from the charging unit, the discharge current flowing through the end portion of the contact region between the electrophotographic photosensitive member and the charging unit is larger than the discharge current flowing through a central portion of the contact region therebetween and therefore the current density of the end portion is specifically high. Thus, it is conceivable that the surface deterioration of the electrophotographic photosensitive member is likely to proceed at the end portion of the contact region and a surface of the electrophotographic photosensitive member receives a large mechanical stress because of the friction between the charging unit and the electrophotographic photosensitive member at the end portion of the contact region and is likely to be worn. Since discharge based on Paschen's law occurs at an edge portion (end portion) of the charging unit in a circumferential direction of the electrophotographic photosensitive member, the discharge exposure time of a surface of the electrophotographic photosensitive member per rotation of the electrophotographic photosensitive member is long, the surface being in contact with an end portion of the charging unit. This is probably one of the reasons. When insulation resistance becomes low because the surface abrasion of the electrophotographic photosensitive member proceeds at the end portion of the contact region, the current from the charging unit to a surface of the electrophotographic photosensitive member is concentrated on the end portion of the contact region and therefore image defects are likely to be caused.

As a result of investigations, the inventors have revealed that satisfying formulae (1) to (3) reduces the surface abrasion of the electrophotographic photosensitive member at the end portion of the contact region to suppress image defects due to friction. In the present invention, a range (L1) where the charging unit contacts the electrophotographic photosensitive member is less than a range (L3) where the surface layer of the electrophotographic photosensitive member is placed and a range (L4) where the charge-generating layer of the electrophotographic photosensitive member is placed is less than the range where the charging unit contacts the electrophotographic photosensitive member. Furthermore, there is a feature that the charging unit and the transfer unit are placed such that a range (L2) where the transfer unit faces the electrophotographic photosensitive member is less than the range where the charging unit contacts the electrophotographic photosensitive member.

The inventors infer a reason why effects of the present invention are obtained because of the feature as described below.

In the image-forming operation of the electrophotographic apparatus, the electrophotographic photosensitive member is subjected to a charging step, an exposure step, a development step, and a transfer step. In the charging step, a voltage is applied to the electrophotographic photosensitive member from a power supply device, whereby a surface of the electrophotographic photosensitive member is charged. In the exposure step, an electrostatic latent image is formed. In the charging step, the electrophotographic photosensitive member is charged such that the surface potential of the electrophotographic photosensitive member is Vd. In the exposure step, the electrophotographic photosensitive member is exposed such that the surface potential of the electrophotographic photosensitive member is Vl. In the transfer step, a transfer bias is applied to the electrophotographic photosensitive member such that the surface potential of the electrophotographic photosensitive member is Vt. In the next step, the electrophotographic photosensitive member needs to be charged such that the surface potential of the electrophotographic photosensitive member is varied from Vt to Vd. Therefore, the potential difference is large and a surface of the electrophotographic photosensitive member is likely to be deteriorated by discharge.

In the present invention, the range where the charge-generating layer of the electrophotographic photosensitive member is placed is less than the range where the charging unit contacts the electrophotographic photosensitive member. Thus, a surface of the electrophotographic photosensitive member that contacts the end portion of the charging unit is a region where no charge-generating layer is placed. Therefore, it is conceivable that in this region, the surface potential of the electrophotographic photosensitive member is not varied to Vl by exposure. In addition, the range where the transfer unit faces the electrophotographic photosensitive member is less than the range where the charging unit contacts the electrophotographic photosensitive member. Thus, the surface of the electrophotographic photosensitive member that contacts the end portion of the charging unit is a region where the transfer unit does not face the electrophotographic photosensitive member. Therefore, it is conceivable that in this region, the surface potential of the electrophotographic photosensitive member is not varied to Vt by transfer. Accordingly, it is conceivable that the potential of the surface of the electrophotographic photosensitive member that contacts the end portion of the charging unit remains about Vd, no significant discharge occurs in the charging step, and the deterioration of the surface of the electrophotographic photosensitive member that contacts the end portion of the charging unit is suppressed.

A discharging step may be performed between the transfer step and the charging step. In the discharging step, the exposure unit is preferably used. In this case, the influence of discharge is small because the potential of the surface of the electrophotographic photosensitive member that contacts the end portion of the charging unit remains about Vd and the surface of the electrophotographic photosensitive member that contacts the end portion of the charging unit is not discharged; hence, effects of the present invention are remarkable.

Furthermore, L1, L2, and L4 preferably satisfy the following formula (4) or (5):

$$L1>L4>L2 \quad (4)$$

$$L1>L2>L4 \quad (5).$$

When Formula (4) or (5) is satisfied, the range where the charge-generating layer is placed is different from the range where the transfer unit faces the electrophotographic photosensitive member, the influence of discharge from an end portion of the transfer unit is reduced, and the surface abrasion of the electrophotographic photosensitive member can be reduced, which is preferred. When L2 is equal to L4, an end portion of a region where the charge-generating layer is placed coincides with an end portion of a region where the transfer unit faces the electrophotographic photosensitive member. In the case of forming the charge-generating layer by a dip coating process, a wet film for forming the charge-generating layer is formed on an axial half of a support by the dip coating process and a lower end portion of the wet film is removed. In this case, the end portion of the region where the charge-generating layer is placed may possibly be thicker than portions other than the end portion thereof. When the end portion of the region where the transfer unit faces the electrophotographic photosensitive member coincides with a thick portion of the charge-generating layer, the influence of discharge from the end portion of the transfer unit to a surface of the electrophotographic photosensitive member is likely to be significant.

Furthermore, L1 is preferably 2 mm or more apart from L4.

Embodiments of the present invention are described below with reference to the attached drawings. The present invention is not limited to the size, material, shape, relative arrangement, and the like of components described in the embodiments unless otherwise specified.

Configuration of Electrophotographic Apparatus

The configuration of an electrophotographic apparatus 100 according to an embodiment of the present invention is described below. FIG. 1 is a schematic sectional view of the electrophotographic apparatus 100.

The electrophotographic apparatus 100 includes a plurality of image-forming sections, that is, a first image-forming section SY for forming a yellow (Y) image, a second image-forming section SM for forming a magenta (M) image, a third image-forming section SC for forming a cyan (C) image, and a fourth image-forming section SK for forming a black (K) image. Referring to FIG. 1, the first, second, third, and fourth image-forming sections SY, SM, SC, and SK are arranged in a line in a direction crossing a vertical direction.

In the electrophotographic apparatus 100, the first to fourth image-forming sections SY to SK are substantially identical in configuration and operation to each other except that images formed thereby are different in color from each other. Thus, in the case of requiring no distinction, Y, M, C, and K are omitted and generic descriptions are provided below.

The electrophotographic apparatus 100 includes four electrophotographic photosensitive members 9 (9Y, 9M, 9C, and 9K) arranged in the direction crossing the vertical direction. The electrophotographic photosensitive members 9 rotate in a direction indicated by Arrow G as shown in FIG. 1. Charging rollers 10 (10Y, 10M, 10C, and 10K) and a scanner unit (exposure device) 11 are placed around the electrophotographic photosensitive members 9.

The electrophotographic photosensitive members 9 are image-carrying members carrying toner images. Each of the charging rollers 10 is a charging unit for uniformly charge a surface of a corresponding one of the electrophotographic photosensitive member 9. The scanner unit (exposure device) 11 is an exposure unit for applying a laser beam to each electrophotographic photosensitive member 9 on the basis of image information to form an electrostatic latent image on the electrophotographic photosensitive member 9. Development units 12 (12Y, 12M, 12C, and 12K) and cleaning blades 14 (14Y, 14M, 14C, and 14K) are placed around the electrophotographic photosensitive members 9.

The development units 12 are development devices developing electrostatic latent images into toner images. The development units 12 may be selected depending on a developing system used herein. Examples of the developing system used herein include a one-component developing system in which development is performed using toner only, a two-component developing system in which development is performed using a mixture of toner and a carrier, a contact developing system in which a photosensitive member comes into contact with toner, and a noncontact developing system. A voltage applied to a development roller is a direct-current voltage only or a voltage obtained by superimposing an alternating-current voltage on a direct-current voltage. The cleaning blades 14 are cleaning members removing toner (transfer remaining toner) remaining on the electrophotographic photosensitive members 9 after transfer. An intermediate transfer belt 28, serving as an intermediate transfer member, for transferring toner images on the electrophotographic photosensitive members 9 onto a transfer material 1 is placed opposite to the four electrophotographic photosensitive members 9.

In the electrophotographic apparatus 100, the electrophotographic photosensitive members 9, the charging rollers 10, the development units 12, and the cleaning blades 14 are combined into cartridges and form process cartridges 8 (8Y, 8M, 8C, and 8K). The process cartridges 8 are detachable from the electrophotographic apparatus 100 through mounting units (not shown), such as mounting guides or positioning members, attached to a body of the electrophotographic apparatus 100.

Referring to FIG. 1, the process cartridges 8 have the same shape. Each of the process cartridges 8 contains a corresponding one of yellow (Y) toner, magenta (M) toner, cyan (C) toner, and black (K) toner. The intermediate transfer belt 28 contacts the four electrophotographic photosensitive members 9 and rotates in a direction indicated by Arrow H as shown in FIG. 1.

The intermediate transfer belt 28 is routed on a plurality of support members (a drive roller 51, a secondary-transfer counter roller 52, and a driven roller 53). Four primary-transfer rollers 13 (13Y, 13M, 13C, and 13K) serving as primary-transfer members are arranged on the inner peripheral surface side of the intermediate transfer belt 28 so as to face the electrophotographic photosensitive members 9. A secondary-transfer roller 32 serving as a secondary-transfer member is placed on the outer peripheral surface of the intermediate transfer belt 28 so as to be located in a position facing the secondary-transfer counter roller 52.

In an image-forming period, surfaces of the electrophotographic photosensitive members 9 are uniformly charged with the charging rollers 10. Next, the charged surfaces of the electrophotographic photosensitive members 9 are scanned and are exposed to a laser beam emitted from the scanner unit 11 depending on image information, whereby electrostatic latent images are formed on the electrophotographic photosensitive members 9 depending on image information. Next, the electrostatic latent images formed on the electrophotographic photosensitive members 9 are developed into toner images with the primary-transfer rollers 13. The toner images carried on the electrophotographic photosensitive members 9 are transferred (primarily transferred) onto the intermediate transfer belt 28 with the primary-transfer rollers 13. In the present invention, the width of the primary-transfer rollers 13 is set to a value described below.

In the case of forming a full-color image, the above process is carried out on the first, second, third, and fourth image-forming sections SY, SM, SC, and SK in that order and color toner images are sequentially superimposed on the intermediate transfer belt 28 and are then primarily transferred. Thereafter, the transfer material 1 is conveyed to a secondary-transfer portion in synchronization with the movement of the intermediate transfer belt 28. Four color toner images on the intermediate transfer belt 28 are secondarily transferred onto the transfer material 1 together by the action of secondary-transfer roller 32 that contacts the intermediate transfer belt 28 with the transfer material 1 therebetween.

The transfer material 1 having the transferred toner image is conveyed to a fixing device 15 serving as a fixing unit. In the fixing device 15, heat and pressure are applied to the transfer material 1, whereby the toner image is fixed to the transfer material 1. Primary-transfer remaining toner remaining on the electrophotographic photosensitive members 9 is removed with the cleaning blades 14 after primary transfer and is recovered in removed-toner chambers 14*c* (14*c*Y, 14*c*M, 14*c*C, and 14*c*K). Secondary-transfer remaining toner remaining on the intermediate transfer belt 28 is removed with an intermediate transfer belt-cleaning device 38.

The electrophotographic apparatus 100 can form a single-color or multi-color image using one or some (not all) of the first to fourth image-forming sections SY to SK.

The intermediate transfer belt 28 is preferably made of a semiconducting resin with a volume resistivity of $1\times10^4$ Ω·cm to $1\times10^{12}$ Ω·cm. In particular, the intermediate transfer belt 28 is made of, for example, a material prepared by dispersing a conductive filler such as carbon in resin such as polycarbonate, polyimide, polyamide, polyvinylidene fluoride, or a tetrafluoroethylene-ethylene copolymer or rubber such as ethylene-propylene rubber, acrylonitrile-butadiene rubber, chloroprene rubber, or polyurethane rubber or an ionic conductive material.

Each primary-transfer roller 13 is composed of a metal core doubling as a charging electrode supplied with a transfer bias and an elastic member placed on an outer peripheral surface of the metal core. The elastic member may be made of, for example, rubber such as urethane rubber, silicone rubber, ethylene-propylene rubber (EPR), an ethylene-propylene-diene terpolymer (EPDM), or isoprene rubber (IR). Examples of a conductive material dispersed in the rubber include carbon, zinc oxide, and tin oxide. The conductive material is dispersed in the rubber, followed by thickly forming the rubber on the metal core by bubbling or molding. The metal core is made of SUS, aluminium, or the like. The rubber is trimmed to a desired shape by polishing as required.

The charging rollers 10 often have a structure in which a conductive elastic layer, a resistance-controlling layer, and a surface layer are stacked on a conductive metal core in that order and may each include at least one metal core and elastic body. The elastic body is made of, for example, resin or rubber such as urethane rubber, SBR, EVA, SBS, SEBS, SIS, TPO, EPDM, EPM, NBR, IR, BR, silicone rubber, or epichlorohydrin rubber. For example, carbon black, carbon fibers, a metal oxide, a metal powder, a solid electrolyte such as a perchlorate, or a conductivity-imparting agent such as a surfactant may be added for the purpose of controlling resistance. The resistance-controlling layer is made of, for example, resin or rubber such as polyamide, polyurethane, fluororesin, polyvinyl alcohol, silicone rubber, NBR, EPDM, CR, IR, BR, or epichlorohydrin rubber or a mixture of such resin or rubber with a conductive filler, an insulating filler, an additive, or the like.

Development rollers 22 each include a mandrel made of a good conductor such as metal and an elastic layer made of a blend of elastic rubber such as EPDM, silicone rubber, or polyurethane rubber or foam of the elastic rubber and a conductive material, such as carbon black, for imparting conductivity, the outer periphery of the mandrel being covered by the elastic layer. Furthermore, the outer periphery of the elastic layer may be covered by a coating film containing a conductive material and resin particles for the purpose of controlling the amount of a developer attached to a surface of each development roller 22.

Process Cartridges

Figure 2:
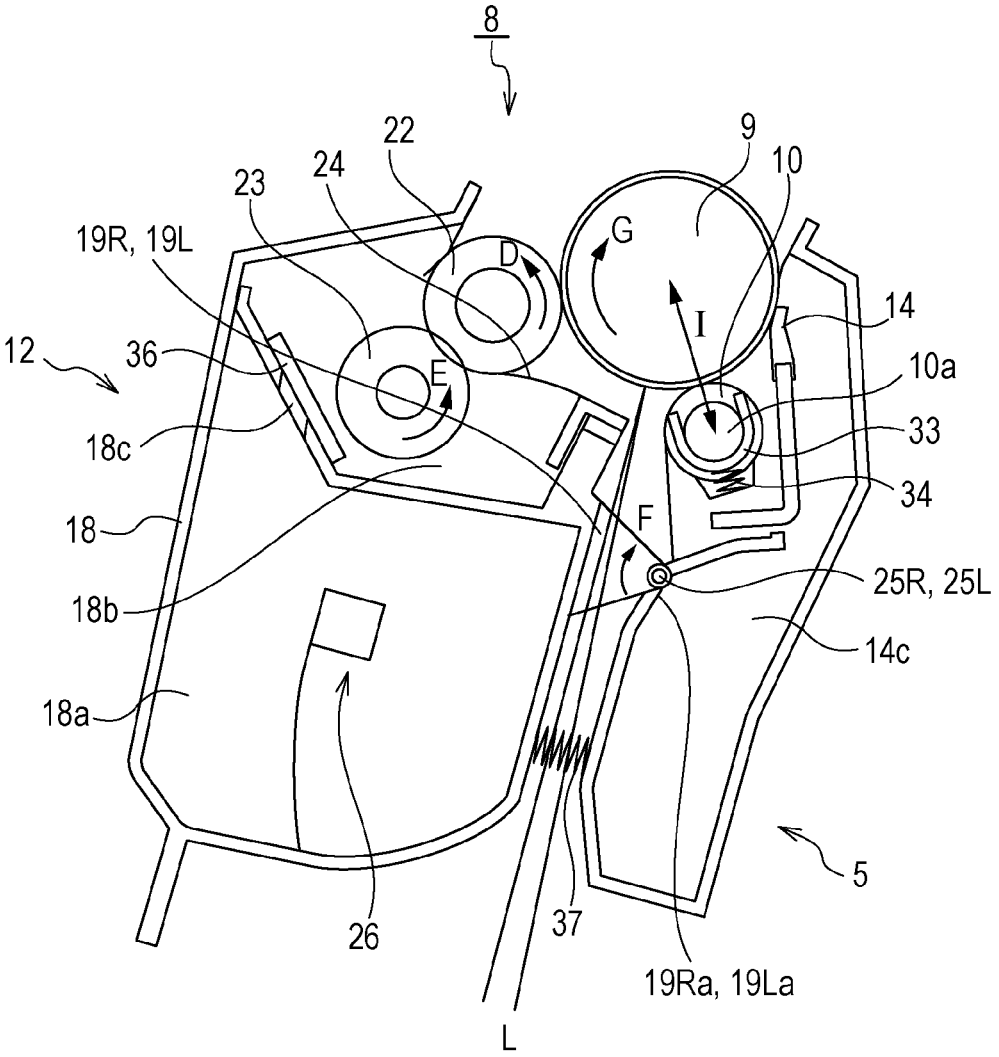
FIG. 2 is a schematic sectional view of a process cartridge according to an embodiment of the present invention.

The configuration of the process cartridges 8, which are mounted in the electrophotographic apparatus 100, is described below with reference to FIG. 2. FIG. 2 is a schematic sectional view of each process cartridge 8 in which a corresponding one of the electrophotographic photosensitive members 9 contacts a corresponding one of the development rollers 22.

Figure 3:
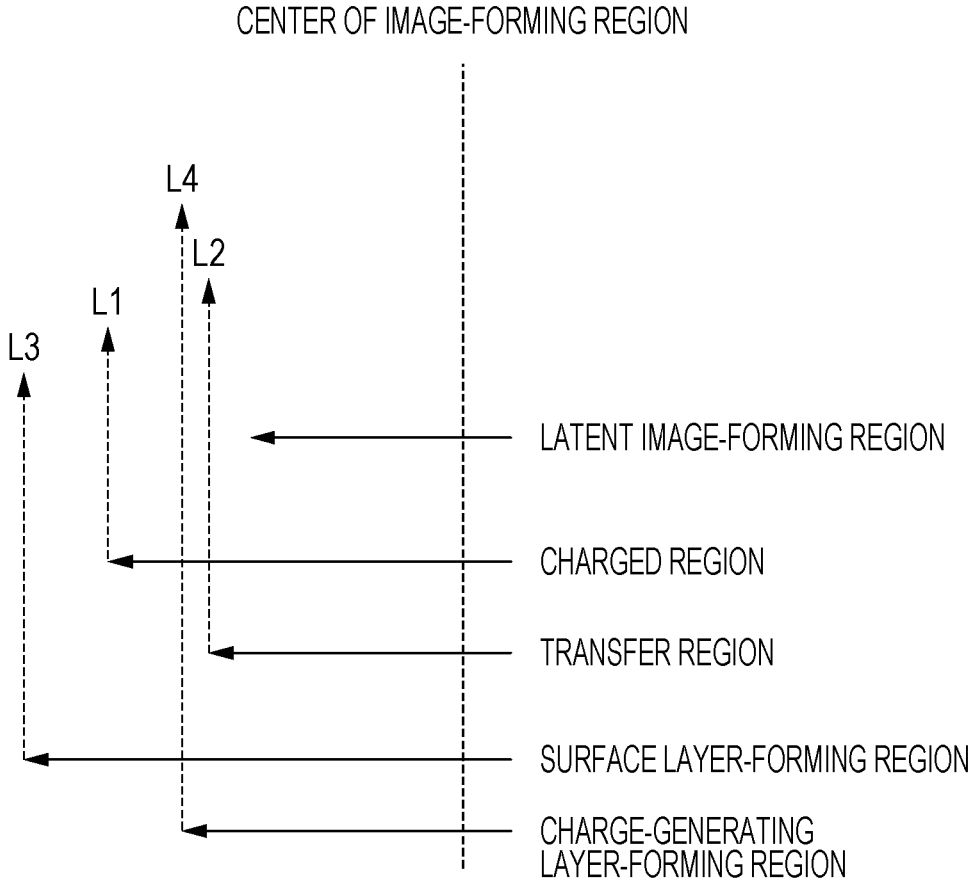
FIG. 3 is an illustration showing the longitudinal relationship between an electrophotographic apparatus and an electrophotographic apparatus in an embodiment of the present invention.
Figure 4:
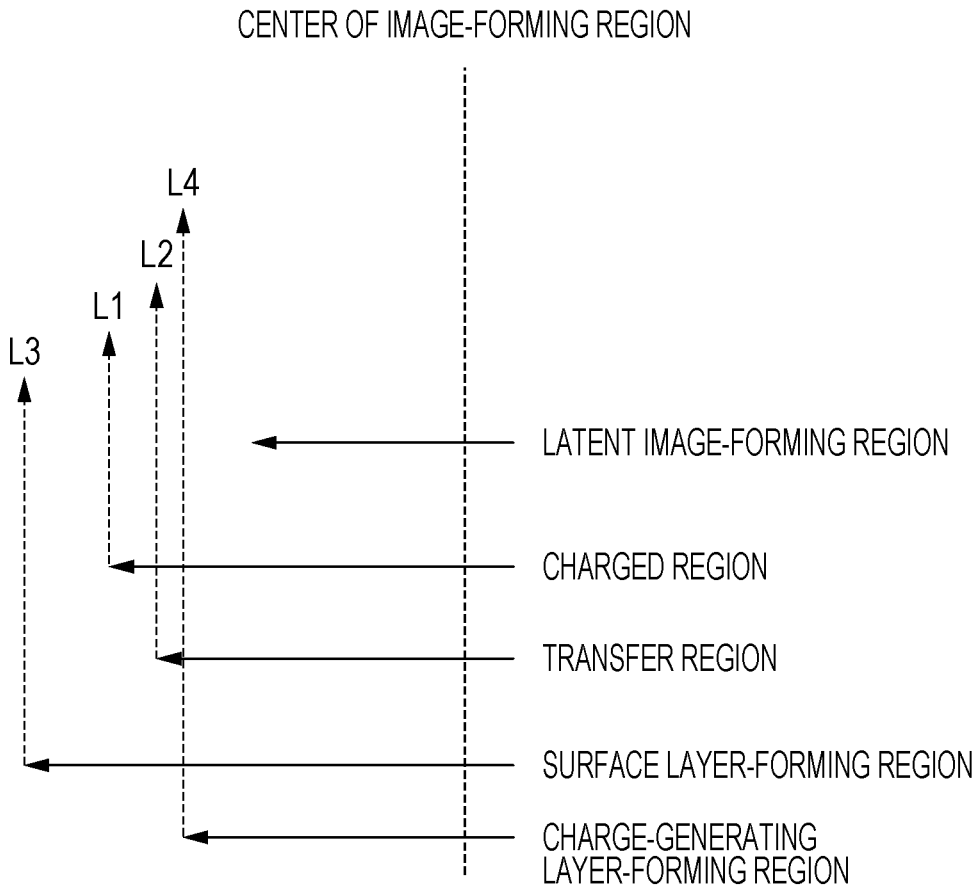
FIG. 4 is an illustration showing the longitudinal relationship between an electrophotographic apparatus and an electrophotographic apparatus in another embodiment of the present invention.

Herein, regarding the process cartridges 8 or components of the process cartridges 8, a longitudinal direction is a direction of the axis of rotation or a direction parallel to the direction of the axis of rotation. FIGS. 3 and 4 show the relationships between a surface layer-forming region, charge-generating layer-forming region, charged region, and transfer region of each electrophotographic photosensitive member 9.

Each process cartridge 8 includes a cleaning frame 5 including a corresponding one of the electrophotographic photosensitive members 9 and the like and a corresponding one of the development units 12. Each development unit 12 includes a corresponding one of the development rollers 22 and the like. The cleaning frame 5 includes a first sub-frame 5*a* serving as a sub-frame supporting various elements in the cleaning frame 5. The electrophotographic photosensitive member 9 is attached to the first sub-frame 5*a* with a bearing (not shown) therebetween so as to be rotatable in a direction indicated by Arrow G as shown in FIG. 2. The electrophotographic photosensitive member 9 of the cleaning frame 5 is irradiated with a laser beam L emitted from a scanner unit placed in an electrophotographic apparatus body.

In the cleaning frame 5, one of the charging rollers 10 and one of the cleaning blades 14 are placed so as to be in contact with a peripheral surface of the electrophotographic photosensitive member 9. Transfer remaining toner is removed from a surface of the electrophotographic photosensitive member 9 with the cleaning blade 14 to drop into one of the removed-toner chambers 14*c*. A charging-roller bearing 33 is attached to the cleaning frame 5 along a line extending through the rotation center of the charging roller 10 and the rotation center of the electrophotographic photosensitive member 9.

The charging-roller bearing 33 is movable in a direction indicated by Arrow I as shown in FIG. 2. A rotating shaft 10*a* of the charging roller 10 is rotatably attached to the charging-roller bearing 33. The charging-roller bearing 33 is urged toward the electrophotographic photosensitive member 9 by a charging roller-pressurizing spring 34 serving as an urging member.

The development unit 12 includes a development frame 18 supporting various elements in the development unit 12. In the development unit 12, the development roller 22 is placed such that the development roller 22 is in contact with the electrophotographic photosensitive member 9 and rotates in a direction (counterclockwise direction) indicated by Arrow D as shown in FIG. 2. The development roller 22 serves as a developer carrier. Both end portions of the development roller 22 in a longitudinal direction (the direction of the axis of rotation) thereof are rotatably supported with the development frame 18 with development bearings (not shown) therebetween. Each of the development bearings is attached to a corresponding one of both side portions of the development frame 18.

The development unit 12 includes a developer-containing chamber (hereinafter referred to as "toner-containing chamber") 18*a* and a developing chamber 18*b* in which the development roller 22 is placed. The toner-containing chamber 18*a* and the developing chamber 18*b* are separated from each other with a partition having an opening 18*c*. Before the process cartridge 8 is delivered, a developer-sealing member 36 for preventing toner in the toner-containing chamber 18*a* from scattering outside the process cartridge 8 is provided on the developing chamber 18*b* side of the opening 18*c*.

After the process cartridges 8 are mounted in the electrophotographic apparatus 100, the developer-sealing member 36 is pulled in the longitudinal direction through a drive array (not shown) of the process cartridges 8, whereby the opening 18*c* is opened. In the developing chamber 18*b*, the following roller and blade are placed: a toner-supplying roller 23 which is in contact with the development roller 22, which rotates in a direction indicated by Arrow E, and which serves as a developer feed member and a development blade 24, serving as a developer-regulating member, for regulating a toner layer of the development roller 22. In the toner-containing chamber 18*a* of the development frame 18, a stirring member 26, stirring toner contained in the toner-containing chamber 18*a*, for conveying the toner to the toner-supplying roller 23 is placed.

The development unit 12 is bonded to the cleaning frame 5 so as to be pivotable about fitting shafts 25 (25R and 25L) fitted in holes 19Ra and 19Lb placed in bearing members 19R and 19L. The development unit 12 is urged by a pressurizing spring 37. Therefore, during the image formation of each process cartridge 8, the development unit 12 rotates about the fitting shafts 25 in a direction indicated by Arrow F and the electrophotographic photosensitive member 9 contacts the development roller 22.

In the present invention, the electrophotographic photosensitive member 9 includes a charge-generating layer and a surface layer placed on the charge-generating layer. The charge-generating layer is placed on a support. An undercoat layer may be placed between the support and a photosensitive layer as required.

Support

The support is preferably a conductive one (conductive support). The support may be, for example, a metal support made of metal such as aluminium or an alloy such as an aluminium alloy or stainless steel. In the case of using aluminium or an aluminium alloy, the support may be an aluminium tube manufactured by a method including an extrusion step and a drawing step or by method including an extrusion step and an ironing step.

Conductive Layer

A conductive layer may be placed between the support and the undercoat layer or the photosensitive layer for the purpose of covering defects of the support. The conductive layer is obtained in such a manner that a wet film of a conductive layer coating fluid prepared by dispersing conductive particles in a binder resin is formed on the support and is then dried. Examples of the conductive particles include carbon black particles; acetylene black particles; metal particles such as aluminium particles, nickel particles, iron particles, chromium particles, copper particles, zinc particles, and silver particles; and metal oxide particles such as conductive tin oxide particles and indium tin oxide (ITO) particles.

Examples of the binder resin include polyester resins, polycarbonate resins, polyvinylbutyral resins, acrylic resins, silicone resins, epoxy resins, melamine resins, urethane resins, phenolic resins, and alkyd resins.

Examples of a solvent for the conductive layer coating fluid include ether solvents, alcohol solvents, ketone solvents, and aromatic hydrocarbon solvents. The conductive layer preferably has a thickness of 0.2 μm to 40 μm, more preferably 1 μm to 35 μm, and further more preferably 5 μm to 30 μm.

Undercoat Layer

An undercoat layer having electrical barrier properties may be placed between the conductive layer and the charge-generating layer for the purpose of inhibiting the charge injection from the conductive layer into the charge-generating layer.

The undercoat layer can be formed in such a manner that a wet film is formed by applying an undercoat layer coating fluid containing resin (a binder resin) to the conductive layer and is then dried.

Examples of the resin contained in the undercoat layer include polyvinyl alcohol, polyvinyl methyl ether, polyacrylic acids, methylcellulose, ethylcellulose, polyglutamic acids, casein, polyamide, polyimide, polyamideimide, polyamic acids, melamine resins, epoxy resins, polyurethane, and polyglutamic esters. In particular, thermoplastic resins are preferred. Among the thermoplastic resins, polyamide is preferred. Polyamide is preferably copolymer nylon.

The undercoat layer preferably has a thickness of 0.1 μm to 2 μm. The undercoat layer may contain an electron transport material (an electron-accepting material such as an acceptor).

Charge-Generating Layer

The charge-generating layer is placed on the conductive layer or the undercoat layer.

Examples of a charge generation material for use in the charge-generating layer include azo pigments, phthalocyanine pigments, indigo pigments, perylene pigments, polycyclic quinone pigments, squarylium dyes, pyrylium salts, thiapyrylium salts, triphenylmethane dyes, quinacridone pigments, azulenium salt pigments, cyanine dyes, xanthene dyes, quinoneimine dyes, and styryl dyes. In particular, metal phthalocyanine such as oxytitanium phthalocyanine, hydroxygallium phthalocyanine, or chlorogallium phthalocyanine is preferred.

The charge-generating layer can be formed in such a manner that a wet film is formed by applying a charge-generating layer coating fluid obtained by dispersing the charge generation material and a binder resin in a solvent to the conductive layer and is then dried. A dispersing method is one using, for example, a homogenizer, an ultrasonic wave, a ball mill, a sand mill, an attritor, a roll mill, or the like.

Examples of the binder resin used in the charge-generating layer include polycarbonate, polyester, polyarylate, butyral resins, polystyrene, polyvinyl acetal, diallyl phthalate resins, acrylic resins, methacrylic resins, vinyl acetate resins, phenolic resins, silicone resins, polysulfone, styrene-butadiene copolymers, alkyd resins, epoxy resins, urea resins, and vinyl chloride-vinyl acetate copolymers. These can be used alone, in combination, or as copolymers.

The mass ratio (charge generation material-to-binder resin ratio) of the charge generation material to the binder resin preferably ranges from 10:1 to 1:10 and more preferably 5:1 to 1:1.

Examples of the solvent used in the charge-generating layer coating fluid include alcohols, sulfoxides, ketones, ethers, esters, halogenated aliphatic hydrocarbons, and aromatic compounds.

The charge-generating layer preferably has a thickness of 5 μm or less and more preferably 0.1 μm to 2 μm.

The charge-generating layer may contain a sensitizing agent, an antioxidant, an ultraviolet absorber, and a plasticizer as required. In order not to disrupt the flow of charge in the charge-generating layer, the charge-generating layer may contain an electron transport material (an electron-accepting material such as an acceptor). The electron transport material may be the same as the electron transport material used in the undercoat layer.

The charge-generating layer is formed in such a manner that a wet film is formed by applying a charge-generating layer coating fluid to the support, the conductive layer, or the undercoat layer and is then dried. In particular, the wet film is formed as follows: the charge-generating layer coating fluid is applied to a central portion (a region other than both end portions of the support in an axial direction thereof) of the support such that no wet film for the charge-generating layer is formed on the end portions of the support in the axial direction thereof and regions exposed outside are formed. Alternatively, the charge-generating layer is formed in such a manner that a wet film of the charge-generating layer coating fluid is formed and both end portions of the wet film in an axial direction of the charge-generating layer are wiped off with a solvent and a wiping member such as a brush, a sponge, or a blade such that regions exposed outside are formed, followed by drying.

Examples of a charge transport material contained in a charge transport layer include triarylamine compounds, hydrazone compounds, styryl compounds, stilbene compounds, pyrazoline compounds, oxazole compounds, thiazole compounds, and triarylmethane compounds.

When the photosensitive layer is a multi-layer type photosensitive layer, the charge transport layer can be formed in such a manner that a charge transport layer coating fluid is prepared by mixing the charge transport material, a binder resin, and a solvent together and a wet film is formed by applying the charge-generating layer coating fluid and is then dried.

Examples of the binder resin used in the charge transport layer include acrylic resins, styrene resins, polyester, polycarbonate, polyarylate, polysulfone, polyphenylene oxide, epoxy resins, polyurethane, and alkyd resins. These can be used alone, in combination, or as copolymers. In particular, a thermoplastic resin is preferably used. Polycarbonate or polyarylate is more preferred.

The mass ratio (charge transport material-to-binder resin ratio) of the charge transport material to the binder resin preferably ranges from 2:1 to 1:2.

Examples of the solvent used in the charge transport layer coating fluid include ketone solvents, ester solvents, ether solvents, aromatic hydrocarbon solvents, and halogenated hydrocarbon solvents.

The charge transport layer preferably has a thickness of 3 μm to 40 μm and more preferably 4 μm to 30 μm.

The charge transport layer may contain an antioxidant, an ultraviolet absorber, and a plasticizer as required.

A protective layer may be placed on the charge transport layer for the purpose of protecting the charge-generating layer.

The protective layer can be formed in such a manner that a wet film is formed by applying a protective layer coating fluid containing resin (a binder resin) to the charge-generating layer and is then dried and/or cured. In the present invention, the surface layer is the outermost layer of each electrophotographic photosensitive member 9. When the protective layer is present, the surface layer is the protective layer. When the protective layer is not present, the surface layer is the charge transport layer. The surface layer is preferably the charge transport layer.

The protective layer preferably has a thickness of 0.5 μm to 10 μm and more preferably 1 μm to 8 μm.

The following processes can be used to apply the coating fluids to the above layers: for example, a dip coating process, a spray coating process, a spinner coating process, a roller coating process, a Meyer bar coating process, and a blade coating process.

EXAMPLES

The present invention is further described below in detail with reference to examples. The present invention is not limited to the examples. Incidentally, the term "parts" used in the examples and comparative examples refers to "mass parts".

Example 1

A support (cylindrical conductive support) was prepare from an aluminium cylinder (JIS-A 3003, an aluminium alloy), manufactured by a method including an extrusion step and a drawing step, having a length of 260.5 mm, a diameter of 24 mm, and a thickness of 1.0 mm.

Next, 214 parts of titanium oxide ($TiO_2$) particles coated with oxygen-deficient tin oxide ($SnO_2$); 132 parts of a phenolic resin, Plyophen™ J-325, available from DIC Corporation, having a solid content of 60% by mass; and 98 parts of 1-methoxy-2-propanol used as a solvent were charged into a sand mill containing 450 parts of glass beads with a diameter of 0.8 mm, followed by dispersing at a rotation speed of 2,000 rpm and a cooling water temperature of 18° C. for a dispersing time of 4.5 h, whereby a dispersion was obtained.

The glass beads were removed from the dispersion using a mesh screen with 150 μm openings.

After the glass beads were removed, silicone resin particles, Tospearl™ 120, available from Momentive Performance Materials Inc., having an average particle diameter of 2 μm were added to the dispersion such that the amount of the silicone resin particles was 10% of the total mass of the titanium oxide particles and phenolic resin in the dispersion. Furthermore, silicone oil, SH 28PA, available from Dow Corning Toray Co., Ltd., was added to the dispersion such that the amount of the silicone oil was 0.01% of the total mass of the titanium oxide particles and phenolic resin in the dispersion, followed by stirring, whereby a conductive layer coating fluid was prepared. The conductive layer coating fluid was applied to the support by a dip coating process, whereby a wet film was obtained. The wet film was dried and heat-cured at 150° C. for 30 minutes, whereby a conductive layer with a thickness of 30 μm was formed.

Next, 4.5 parts of N-methoxymethylated nylon, Toresin™ EF-30T, available from Teikoku Kagaku Sangyo K. K. and 1.5 parts of a copolymer nylon resin, AMILAN™ CM8000, available from Toray Industries Inc. were dissolved in a solvent mixture of 65 parts of methanol and 30 parts of n-butanol, whereby an undercoat layer coating fluid was prepared. The undercoat layer coating fluid was applied to the conductive layer by the dip coating process, whereby a wet film was obtained. The wet film was dried at 70° C. for 6 minutes, whereby an undercoat layer with a thickness of 0.85 μm was formed.

Next, the following crystal was prepared: a hydroxygallium phthalocyanine crystal (charge generation material) having peaks at Bragg angles (2θ±0.2°) of 7.5°, 9.9°, 16.3°, 18.6°, 25.1°, and 28.3° as determined by characteristic X-ray diffraction with Cu Kα radiation. Ten parts of the hydroxygallium phthalocyanine crystal; 5 parts of polyvinylbutyral, S-LEC™ BX-1, available from Sekisui Chemical Co., Ltd.; and 250 parts of cyclohexanone were charged into a sand mill containing glass beads with a diameter of 1 mm, followed by dispersing for a dispersing time of 3 h, whereby a dispersion was obtained. After the glass beads were removed from the dispersion, 250 parts of ethyl acetate was added to the dispersion, whereby a charge-generating layer coating fluid was prepared. The charge-generating layer coating fluid was applied to the undercoat layer by the dip coating process, whereby a wet film was formed. The wet film was partly wiped off with lens-cleaning paper impregnated with methyl ethyl ketone (MEK) such that L4 was 115.0 mm. The resulting wet film was dried at 100° C. for 10 minutes, whereby a charge-generating layer with a thickness of 0.12 μm was formed.

Next, 9 parts of an amine compound (hole transport material) represented by Formula (CT-1) below and 10 parts of a polyarylate resin, containing a structural unit represented by Formula (B1) below and a structural unit represented by Formula (B2) below at a ratio of 5:5, having a weight-average molecular weight (Mw) of 100,000 were dissolved in a solvent mixture of 30 parts of dimethoxymethane and 70 parts of chlorobenzene, whereby a charge transport layer coating fluid was prepared. The charge transport layer coating fluid was applied to the charge-generating layer by the dip coating process, whereby a wet film was obtained. The wet film was partly wiped off with lens-cleaning paper impregnated with MEK such that L3 was 125.0 mm. The resulting wet film was dried at 120° C. for 40 minutes, whereby a charge transport layer with a thickness of 15 μm was formed.

(CT-1)

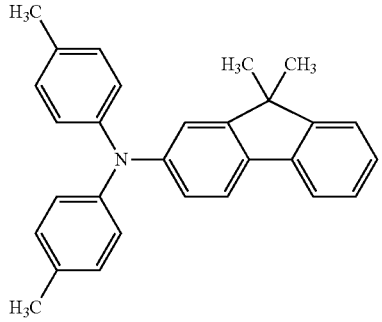

(B1)

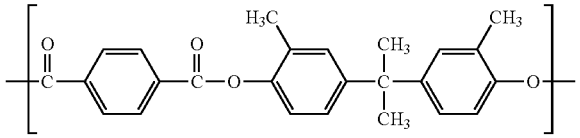

-continued (B2)

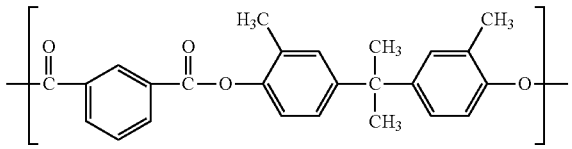

Evaluation is described below. A device used was a modified laser beam printer, Color LaserJet CP3525dn, using a contact one-component developing system. The laser beam printer was modified such that a range where a charging roller contacted an electrophotographic photosensitive member, that is, L1 was 120.0 mm and the peripheral speed difference of the charging roller with respect to the electrophotographic photosensitive member was 150%. Furthermore, the contact pressure of the charging roller to the electrophotographic photosensitive member was doubled. After the electrophotographic photosensitive member was charged by applying a direct-current voltage to the charging roller, the surface potential of the electrophotographic photosensitive member at the center of an image-forming region in a development position was set to −600 V. A range where a primary transfer roller faced the electrophotographic photosensitive member, that is, L2 was set to 110.0 mm.

Image formation evaluation was repeatedly performed using the above device. Image formation evaluation was performed in such a manner that an image with a coverage rate of 1% was formed on 30,000 sheets of letter paper with a width of 215.9 mm at two-sheet intervals in an environment with a temperature of 23° C. and a relative humidity of 50%. The thickness of the electrophotographic photosensitive member was measured before and after image formation was repeatedly performed. The wear depth of the most worn portion near an end portion (both end sides) of the charging roller was expressed as D in μm. In Example 1, L1 to L4 were set such that in a longitudinal direction of the electrophotographic photosensitive member, the length of each of L1 to L4 from the center to an end of the image-forming region was equal to the length of each of L1 to L4 from the center to the other end of the image-forming region.

Incidentally, a measuring instrument, FISCHERSCOPE mms, available from Fischer Instruments K. K. was used to measure the thickness of each layer of the electrophotographic photosensitive member.

L1 to L4, the wear depth D, and image evaluation results obtained in Example 1 are shown in the table.

Examples 2 to 9

Electrophotographic photosensitive members were prepared in substantially the same manner as that described in Example 1 except that L2 and L4 were changed. The electrophotographic photosensitive members were evaluated using the same device as that described in Example 1. L1 to L4, the wear depth D, and image evaluation results obtained in Examples 2 to 9 are shown in the table.

Example 10

A support (cylindrical conductive support) was prepared from an aluminium cylinder (JIS-A 3003, an aluminium alloy), manufactured by a method including an extrusion step and a drawing step, having a length of 357.5 mm, a diameter of 30 mm, and a thickness of 0.7 mm.

Next, 214 parts of titanium oxide ($TiO_2$) particles coated with oxygen-deficient tin oxide ($SnO_2$); 132 parts of a phenolic resin, Plyophen™ J-325; and 98 parts of 1-methoxy-2-propanol used as a solvent were charged into a sand mill containing 450 parts of glass beads with a diameter of 0.8 mm, followed by dispersing at a rotation speed of 2,000 rpm and a cooling water temperature of 18° C. for a dispersing time of 4.5 h, whereby a dispersion was obtained.

The glass beads were removed from the dispersion using a mesh screen with 150 μm openings.

After the glass beads were removed, silicone resin particles, Tospearl™ 120, having an average particle diameter of 2 μm were added to the dispersion such that the amount of the silicone resin particles was 2% of the total mass of the titanium oxide particles and phenolic resin in the dispersion. Furthermore, silicone oil, SH 28PA, available from Dow Corning Toray Co., Ltd., was added to the dispersion such that the amount of the silicone oil was 0.01% of the total mass of the titanium oxide particles and phenolic resin in the dispersion, followed by stirring, whereby a conductive layer coating fluid was prepared. The conductive layer coating fluid was applied to the support by a dip coating process, whereby a wet film was obtained. The wet film was dried and heat-cured at 150° C. for 30 minutes, whereby a conductive layer with a thickness of 18 μm was formed.

Next, 40 parts of N-methoxymethylated nylon, Toresin™ EF-30T, was dissolved in a solvent mixture of 400 parts of methanol and 200 parts of n-butanol, whereby an undercoat layer coating fluid was prepared. The undercoat layer coating fluid was applied to the conductive layer by the dip coating process, whereby a wet film was obtained. The wet film was dried at 100° C. for 30 minutes, whereby an undercoat layer with a thickness of 0.40 μm was formed.

Next, the following crystal was prepared: a hydroxygallium phthalocyanine crystal (charge generation material) having peaks at Bragg angles (2θ±0.2°) of 7.5°, 9.9°, 16.3°, 18.6°, 25.1°, and 28.3° as determined by characteristic X-ray diffraction with Cu Kα radiation.

Twenty parts of the hydroxygallium phthalocyanine crystal; 0.2 parts of a compound represented by Formula (A) below; 10 parts of polyvinylbutyral, S-LEC™ BX-1; and 800 parts of cyclohexanone were charged into a sand mill containing glass beads with a diameter of 1 mm, followed by dispersing for a dispersing time of 4 h, whereby a dispersion was obtained. After the glass beads were removed from the dispersion, 700 parts of ethyl acetate was added to the dispersion, whereby a charge-generating layer coating fluid was prepared. The charge-generating layer coating fluid was applied to the undercoat layer by the dip coating process, whereby a wet film was formed. The wet film was partly wiped off with lens-cleaning paper impregnated with Methyl ethyl ketone (MEK) such that L4 was 159.0 mm. The resulting wet film was dried at 100° C. for 10 minutes, whereby a charge-generating layer with a thickness of 0.18 μm was formed.

(A)

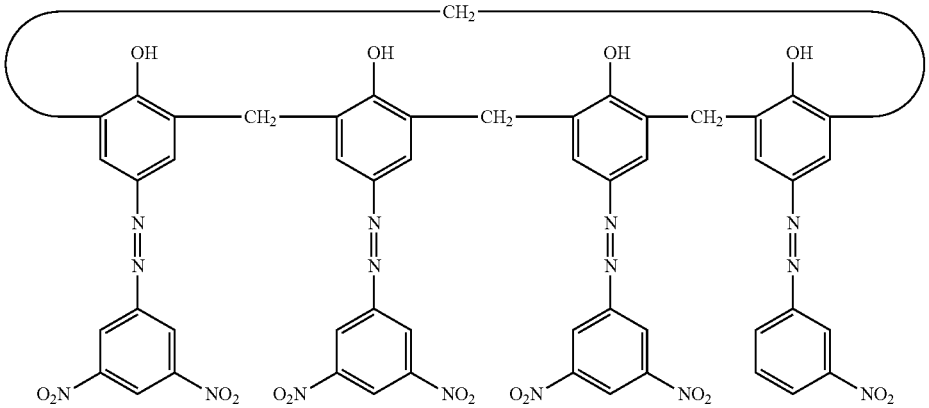

Next, 72 parts of an amine compound represented by Formula (CT-1), 8 parts of an amine compound (hole transport material) represented by Formula (CT-2) below, 100 parts of a polyarylate resin, containing a structural unit represented by Formula (B3) below and a structural unit represented by Formula (B4) below at a ratio of 7:3, having a weight-average molecular weight (Mw) of 130,000 were dissolved in a solvent mixture of 300 parts of dimethoxymethane and 600 parts of chlorobenzene, whereby a charge transport layer coating fluid was prepared. The charge transport layer coating fluid was applied to the charge-generating layer by the dip coating process, whereby a wet film was obtained. The wet film was partly wiped off with lens-cleaning paper impregnated with MEK such that L3 was 175.0 mm. The resulting wet film was dried at 120° C. for 40 minutes, whereby a charge transport layer with a thickness of 15 μm was formed.

(CT-2)

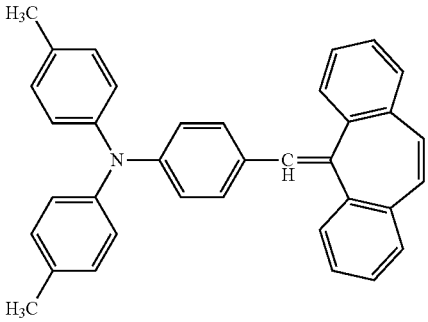

(B3)

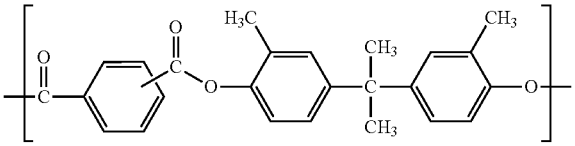

(B4)

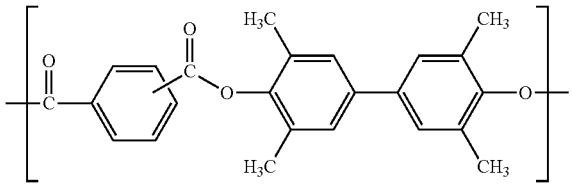

Evaluation is described below. A device used was a modified copier, iR-ADVC5051, available from Canon Kabushiki Kaisha, using a two-component developing system. The copier was modified such that a range where a charging roller contacted an electrophotographic photosensitive member, that is, L1 was 162.0 mm and the peripheral speed difference of the charging roller with respect to the electrophotographic photosensitive member was 150%. Furthermore, the contact pressure of the charging roller to the electrophotographic photosensitive member was doubled. A voltage obtained by superimposing an alternating-current voltage on a direct-current voltage was applied to the charging roller and an AC bias was 2.5 kHz, 1.7 kVpp. After the electrophotographic photosensitive member was charged, the surface potential of the electrophotographic photosensitive member at the center of an image-forming region in a development position was set to −600 V. A range where a primary transfer roller faced the electrophotographic photosensitive member, that is, L2 was set to 156.0 mm.

Image formation evaluation was repeatedly performed using the above device. Image formation was repeatedly performed in such a manner that an image with a coverage rate of 1% was formed on 50,000 sheets of letter paper with a width of 279.4 mm at two-sheet intervals in an environment with a temperature of 23° C. and a relative humidity of 50%. The thickness of the electrophotographic photosensitive member was measured before and after image formation was repeatedly performed. The wear depth of the most worn portion (eight points measured in a circumferential direction in increments of 5 mm at intervals of 1 mm on both end sides) near an end portion of the charging roller was expressed as D in μm. In Example 10, L1 to L4 were set such that in a longitudinal direction of the electrophotographic photosensitive member, the length of each of L1 to L4 from the center to an end of the image-forming region was equal to the length of each of L1 to L4 from the center to the other end of the image-forming region.

Example 11

An electrophotographic photosensitive member was prepared in substantially the same manner as that described in Example 1 except that a cylindrical conductive support, L1 to L4, and a device for evaluation were changed. L1 to L4, the wear depth D, and image evaluation results obtained in Example 11 are shown in the table.

A support (cylindrical conductive support) used was an aluminium cylinder (JIS-A 3003, an aluminium alloy), manufactured by a method including an extrusion step and a drawing step, having a length of 260.5 mm, a diameter of 30 mm, and a thickness of 1.0 mm.

Evaluation is described below. A device used was a modified copier, HP LaserJet Enterprise 600 M603, available from Canon Kabushiki Kaisha, using a noncontact one-component developing system. The copier was modified such that a range where a charging roller contacted an electrophotographic photosensitive member, that is, L1 was 110.0 mm and the peripheral speed difference of the charging roller with respect to the electrophotographic photosensitive member was 150%. Furthermore, the contact pressure of the charging roller to the electrophotographic photosensitive member was doubled. A voltage obtained by superimposing an alternating-current voltage on a direct-current voltage was applied to the charging roller and an AC bias was 1.6 kHz, 1.7 kVpp. After the electrophotographic photosensitive member was charged, the surface potential of the electrophotographic photosensitive member at the center of an image-forming region in a development position was set to −600 V. A range where a primary transfer roller faced the electrophotographic photosensitive member, that is, L2 was set to 100.0 mm.

Image formation evaluation was repeatedly performed using the above device. Image formation was repeatedly performed in such a manner that an image with a coverage rate of 1% was formed on 30,000 sheets of letter paper with a width of 215.9 mm at two-sheet intervals in an environment with a temperature of 23° C. and a relative humidity of 50%. The thickness of the electrophotographic photosensitive member was measured before and after image formation was repeatedly performed. The wear depth of the most worn portion (eight points measured in a circumferential direction in increments of 5 mm at intervals of 1 mm on both end sides) near an end portion of the charging roller was expressed as D in μm. In Example 11, L1 to L4 were set such that in a longitudinal direction of the electrophotographic photosensitive member, the length of each of L1 to L4 from the center to an end of the image-forming region was equal to the length of each of L1 to L4 from the center to the other end of the image-forming region.

Comparative Examples 1 and 2

Electrophotographic photosensitive members were prepared in substantially the same manner as that described in Example 1 except that L2 and L4 were changed. The electrophotographic photosensitive members were evaluated using the same device as that described in Example 1. L1 to L4, the wear depth D, and image evaluation results obtained in Comparative Examples 1 and 2 are shown in the table.

Comparative Example 3

An electrophotographic photosensitive member was prepared in substantially the same manner as that described in Example 10 except that L4 was changed. The electrophotographic photosensitive member was evaluated using the same device as that described in Example 10. L1 to L4, the wear depth D, and image evaluation results obtained in Comparative Example 3 are shown in the table.

Comparative Example 4

An electrophotographic photosensitive member was prepared in substantially the same manner as that described in Example 10 except that L4 was changed. The electrophotographic photosensitive member was evaluated using the same device as that described in Example 10. L1 to L4, the wear depth D, and image evaluation results obtained in Comparative Example 3 are shown in the table.

TABLE

| | L1 (mm) | L2 (mm) | L3 (mm) | L4 (mm) | D (μm) | Image |
|---|---|---|---|---|---|---|
| Example 1 | 120.0 | 110.0 | 125.0 | 115.0 | 10.0 | No defects |
| Example 2 | 120.0 | 110.0 | 125.0 | 117.0 | 11.0 | No defects |
| Example 3 | 120.0 | 110.0 | 125.0 | 113.0 | 11.4 | No defects |
| Example 4 | 120.0 | 110.0 | 125.0 | 111.0 | 11.6 | No defects |
| Example 5 | 120.0 | 115.0 | 125.0 | 115.0 | 12.9 | No defects |
| Example 6 | 120.0 | 113.0 | 125.0 | 111.0 | 11.8 | No defects |
| Example 7 | 120.0 | 115.0 | 125.0 | 111.0 | 11.7 | No defects |
| Example 8 | 120.0 | 118.0 | 125.0 | 111.0 | 11.6 | No defects |
| Example 9 | 120.0 | 110.0 | 125.0 | 118.0 | 12.3 | No defects |
| Example 10 | 162.0 | 156.0 | 175.0 | 159.0 | 12.5 | No defects |
| Example 11 | 110.0 | 100.0 | 125.0 | 105.0 | 12.5 | No defects |
| Comparative Example 1 | 120.0 | 110.0 | 125.0 | 125.0 | 14.7 | Black horizontal stripe |
| Comparative Example 2 | 120.0 | 123.0 | 125.0 | 125.0 | 15.0 | Black horizontal stripe |
| Comparative Example 3 | 162.0 | 156.0 | 175.0 | 175.0 | 15.0 | Black horizontal stripe |
| Comparative Example 4 | 110.0 | 100.0 | 125.0 | 125.0 | 15.0 | Black horizontal stripe |

From the above results, it is clear that in an example of the present invention, the surface abrasion of an electrophotographic photosensitive member contacting an end portion of a charging unit is reduced and image defects due to the surface abrasion thereof are suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-170999, filed Aug. 25, 2014, which is hereby incorporated by reference herein in its entirety.

What is claimed is:

1. An electrophotographic apparatus comprising:

a cylindrical electrophotographic photosensitive member for carrying a toner image;

a charging unit contacting the electrophotographic photosensitive member; and a transfer unit for transferring the toner image carried on the electrophotographic photosensitive member onto a transfer material, wherein the electrophotographic photosensitive member includes a charge-generating layer and a surface layer on the charge-generating layer and the electrophotographic apparatus satisfies the following formulae (1) and (4):

$$L1<L3 \quad (1)$$

$$L1>L4>L2 \quad (4)$$

where L1 represents a range (mm) from the center of an image-forming region of the electrophotographic photosensitive member to an end of a charged region of the electrophotographic photosensitive member in a longitudinal direction of the electrophotographic photosensitive member, L2 represents a range (mm) from the center of the image-forming region to an end of a transfer region of the electrophotographic photosensitive member in the longitudinal direction of the electrophotographic photosensitive member, L3 represents a range (mm) from the center of the image-forming region to an end of a region where the surface layer is placed in the longitudinal direction of the electrophotographic photosensitive member, and L4 represents a range (mm) from the center of the image-forming region to an end of a region where the charge-generating layer is placed in the longitudinal direction of the electrophotographic photosensitive member.

2. The electrophotographic apparatus according to claim 1, wherein the surface layer is a charge transport layer.

3. An electrophotographic apparatus comprising:

a cylindrical electrophotographic photosensitive member for carrying a toner image;

a charging unit contacting the electrophotographic photosensitive member; and a transfer unit for transferring the toner image carried on the electrophotographic photosensitive member onto a transfer material, wherein the electrophotographic photosensitive member includes a charge-generating layer and a surface layer on the charge-generating layer and the electrophotographic apparatus satisfies the following formulae (1) and (5):

$$L1<L3 \quad (1)$$

$$L1>L2>L4 \quad (5)$$

where L1 represents a range (mm) from the center of an image-forming region of the electrophotographic photosensitive member to an end of a charged region of the electrophotographic photosensitive member in a longitudinal direction of the electrophotographic photosensitive member, L2 represents a range (mm) from the center of the image-forming region to an end of a transfer region of the electrophotographic photosensitive member in the longitudinal direction of the electrophotographic photosensitive member, L3 represents a range (mm) from the center of the image-forming region to an end of a region where the surface layer is placed in the longitudinal direction of the electrophotographic photosensitive member, and L4 represents a range (mm) from the center of the image-forming region to an end of a region where the charge-generating layer is placed in the longitudinal direction of the electrophotographic photosensitive member.

4. The electrophotographic apparatus according to claim 3, wherein the surface layer is a charge transport layer.

5. A process cartridge detachable from an electrophotographic apparatus body, comprising:

a cylindrical electrophotographic photosensitive member for carrying a toner image; and a charging unit contacting the electrophotographic photosensitive member, wherein the electrophotographic photosensitive member includes a charge-generatinq layer, a surface layer on the charge-generating layer, and a transfer region capable of facing a transfer unit for transferring the toner image carried on the electrophotographic photosensitive member onto a transfer material and the process cartridge satisfies the following formulae (1) and (4):

$$L1<L3 \quad (1)$$

$$L1>L4>L2 \quad (4)$$

where L1 represents a range (mm) from the center of an image-forming region of the electrophotographic photosensitive member to an end of a charged region of the electrophotographic photosensitive member in a longitudinal direction of the electrophotographic photosensitive member, L2 represents a range (mm) from the center of the image-forming region to an end of a transfer region of the electrophotographic photosensitive member in the longitudinal direction of the electrophotographic photosensitive member, L3 represents a range (mm) from the center of the image-forming region to an end of a region where the surface layer is placed in the longitudinal direction of the electrophotographic photosensitive member, and L4 represents a range (mm) from the center of the image-forming region to an end of a region where the charge-generating layer is placed in the longitudinal direction of the electrophotographic photosensitive member.

6. The process cartridge according to claim 5 , wherein the surface layer is a charge transport layer.

7. A process cartridge detachable from an electrophotographic apparatus body, comprising:

a cylindrical electrophotographic photosensitive member for carrying a toner image; and a charging unit contacting the electrophotographic photosensitive member, wherein the electrophotographic photosensitive member includes a charge-generating layer, a surface layer on the charge-generating layer, and a transfer region capable of facing a transfer unit for transferring the toner image carried on the electrophotographic photosensitive member onto a transfer material and the process cartridge satisfies the following formulae (1) and (5):

$$L1<L3 \quad (1)$$

$$L1>L2>L4 \quad (5)$$

where L1 represents a range (mm) from the center of an image-forming region of the electrophotographic photosensitive member to an end of a charged region of the electrophotographic photosensitive member in a longitudinal direction of the electrophotographic photosensitive member, L2 represents a range (mm) from the center of the image-forming region to an end of a transfer region of the electrophotographic photosensitive member in the longitudinal direction of the electrophotographic photosensitive member, L3 represents a range (mm) from the center of the image-forming region to an end of a region where the surface layer is placed in the longitudinal direction of the electrophotographic photosensitive member, and L4 represents a range (mm) from the center of the image-forming region to an end of a region where the charge-generating layer is placed in the longitudinal direction of the electrophotographic photosensitive member.

8. The process cartridge according to claim 7, wherein the surface layer is a charge transport layer.

* * * * *